US009234388B2

(12) United States Patent
Altieri, Jr.

(10) Patent No.: US 9,234,388 B2
(45) Date of Patent: Jan. 12, 2016

(54) REMOVABLE WINDOW AND DOOR SCREENS

(71) Applicant: Joseph A. Altieri, Jr., Pittsburgh, PA (US)

(72) Inventor: Joseph A. Altieri, Jr., Pittsburgh, PA (US)

(73) Assignee: Flexscreen LLC, Murrysville, PA (US)

( * ) Notice: Subject to any disclaimer, the term of this patent is extended or adjusted under 35 U.S.C. 154(b) by 0 days.

(21) Appl. No.: 14/221,604

(22) Filed: Mar. 21, 2014

(65) Prior Publication Data

US 2014/0290873 A1 Oct. 2, 2014

Related U.S. Application Data

(63) Continuation-in-part of application No. 13/853,632, filed on Mar. 29, 2013, and a continuation-in-part of application No. 14/051,066, filed on Oct. 10, 2013.

(51) Int. Cl.

| | |
|---|---|
| ***E06B 9/52*** | (2006.01) |
| ***E06B 9/06*** | (2006.01) |
| ***E06B 9/24*** | (2006.01) |

(52) U.S. Cl.

CPC ..... *E06B 9/0692* (2013.01); *E06B 9/24* (2013.01); *E06B 9/52* (2013.01); *E06B 9/522* (2013.01); *E06B 2009/527* (2013.01)

(58) Field of Classification Search

USPC ..... 160/105, 370.21, 369, 371, 90, 96, 97, 160/377, 375, 376, 91

IPC ..... E06B 2009/527,9/521

See application file for complete search history.

(56) References Cited

U.S. PATENT DOCUMENTS

| | | | | |
|---|---|---|---|---|
| 246,153 | A | | 8/1881 | Koch |
| 792,833 | A | | 6/1905 | Lee |
| 1,736,688 | A | | 11/1929 | Yerby et al. |
| 1,756,227 | A | | 4/1930 | Torrent |
| 1,760,612 | A | | 5/1930 | Trott |
| 1,856,323 | A | | 5/1932 | Feaster |
| 2,532,886 | A | | 12/1950 | Bianchi |
| 2,598,770 | A | * | 6/1952 | Drozt ..... 160/105 |
| 2,612,947 | A | * | 10/1952 | Jenks ..... 160/40 |
| 2,625,217 | A | * | 1/1953 | Spiller et al. ..... 160/90 |
| 2,722,978 | A | * | 11/1955 | Frisk ..... 160/40 |
| 2,914,123 | A | * | 11/1959 | Denble ..... 160/105 |
| 3,107,991 | A | * | 10/1963 | Taussig ..... 55/511 |
| 5,003,905 | A | | 4/1991 | Raynor |
| 5,024,262 | A | * | 6/1991 | Huang ..... 160/370.21 |
| 5,116,273 | A | * | 5/1992 | Chan ..... 160/370.21 |
| 5,469,906 | A | * | 11/1995 | Cason ..... 160/105 |
| 5,845,697 | A | * | 12/1998 | Zheng ..... 160/370.21 |
| 6,108,997 | A | | 8/2000 | Blais et al. |

(Continued)

OTHER PUBLICATIONS

PCT/US2014/031409—International Search Report—Mailing date Aug. 20, 2014.

*Primary Examiner* — David Purol
(74) *Attorney, Agent, or Firm* — Ronald Law Group, LLC

(57) ABSTRACT

Screens for use in door or window openings are disclosed. The screens have a screen frame having at least one portion fabricated from a material possessing spring-like characteristics and a screen mesh that is secured to the screen frame to cover the door or window opening. The screen frame and screen mesh are in tension when the screen resides in the door or window opening. The screen frame may be deformed temporarily, due to its fabrication, allow for simple and easy removal and insertion of the screens into the door or window opening.

27 Claims, 3 Drawing Sheets

(56) References Cited

U.S. PATENT DOCUMENTS 6,484,789 B1 11/2002 Ober
6,708,751 B1 3/2004 Shulman
7,644,749 B2 * 1/2010 Rawdon et al. ..... 160/371
2005/0133950 A1 6/2005 Eustace et al.

* cited by examiner

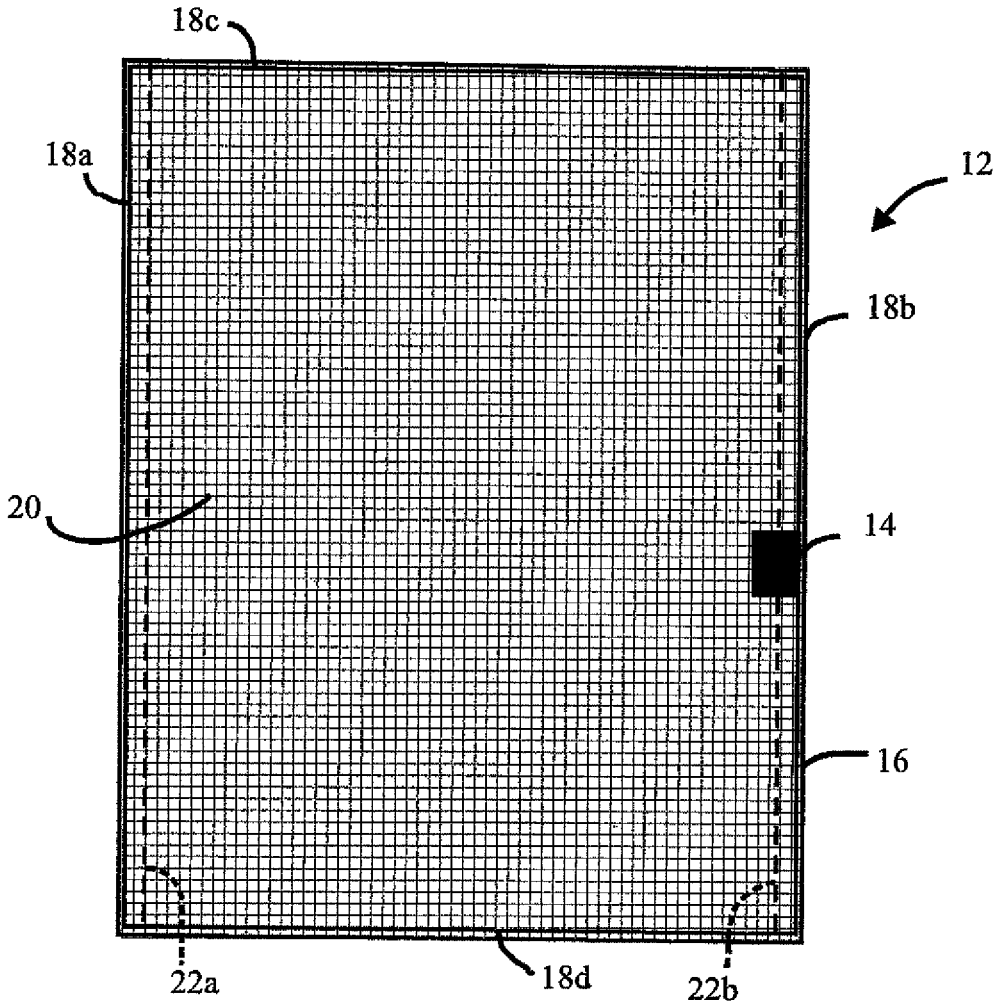
FIG. 3
FIG. 4
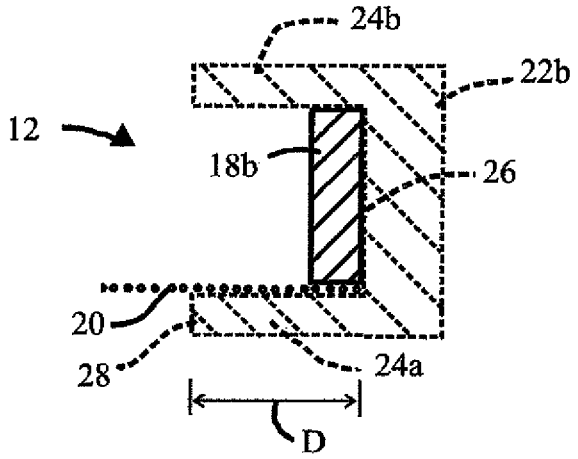

REMOVABLE WINDOW AND DOOR SCREENS

CROSS-REFERENCE TO RELATED APPLICATIONS

This application is a continuation-in-part of U.S. patent application Ser. No. 13/853,632 filed on Mar. 29, 2013 and U.S. patent application Ser. No. 14/051,066 filed on Oct. 10, 2013 and claims the benefit under 35 U.S.C. §119(e) of those earlier filing dates. Both of those earlier-filed applications are incorporated by reference as if more fully set forth herein.

BACKGROUND OF THE INVENTION

1. Field of the Invention

The invention relates generally to removable window and door screens and more specifically to embodiments of screens that are easily removed from within parallel tracks of an opening of the window or door.

2. Background of the Art

Screens have been used for thousands of years for keeping insects, leaves, birds, and debris from entering a building or other structure while permitting the inflow of fresh air. In ancient times, cloth or wicker attached to a frame was used to make the screen. Modernly, most screens consist of a fiberglass mesh or netting held taut and supported by an aluminum frame. Other common mesh materials include nylon, polyester, bronze, stainless steel, aluminum, copper, brass, and galvanized steel. Other common frame materials include wood, steel, and vinyl, sometimes in combination with each other and/or aluminum, though over the years other materials have been tried, including rubber, fiberglass, and closed-cell foams. Some screens have no frames, but are mesh material that is made to roll out from a spool and then be held taut across an opening by fastening the screen mesh to door or window itself.

Despite the maturity of the art of screen making, some improvements are still needed. One of those needed improvements relates to a type of screen which is in common use in modern residential and commercial construction. This screen type is referred to herein as a "groove-attachment screen." The groove-attachment screen is held in place in the door or window opening in which it is intended to be used by way of parallel sides of its frame fitting within receiving grooves running along two parallel sides of the door or window opening. One or more springs typically project from one of the two vertical sides of the screen frame. In some cases, the receiving grooves are located on the vertical sides of the window or door opening, while in others they are located on the top and bottom sides of the window or door opening. Typically, one of the receiving grooves is a full-groove, i.e., a u-shaped groove, while the other receiving groove may be either a full groove or an a partial groove i.e., a groove having a bottom seating side and either just one retaining wall side or two retaining wall sides of unequal height.

During installation of a conventional groove-attachment screen, the side of the screen frame which has the spring or springs extending from it is angled into one of the receiving grooves of the door or window opening. The body of the screen then is rotated into the plane defined by the receiving grooves while the screen frame side having the spring or springs is pressed into its receiving groove to compress its attached spring or springs. This compression allows the opposite screen frame side to slip past the lip of its receiving groove. Once it does, the person installing the frame stops pressing against the spring side of the screen frame so that the spring or springs release some of their tension and cause the opposite side of the spring frame to seat against the bottom of its receiving groove. The screen is removed by reversing the installation process, i.e., by pressing the spring side of the screen frame into its receiving groove to unseat the opposite side of the screen frame while rotating the screen body so that the unseated screen frame side passes the lip of its receiving groove, and then withdrawing the spring side of the screen frame out of its receiving groove.

One problem with the conventional groove-attachment screen is that it can be difficult to install and to remove from the receiving grooves of window or door opening. This is especially true for difficult to reach windows and for large window or door openings since in such cases it is difficult to simultaneously compress all of the retaining springs along one side of the screen frame while fitting or withdrawing the opposing side of the screen frame into or out of its receiving groove. This problem is often aggravated when the corners or the frame members lack sufficient rigidity to maintain the frame in a single plane, the sides of the frame in alignment with one another, or the corners in their use-angles (which are usually right angles for square or rectangular window or door openings). Another problem with the conventional groove-attachment screen is that its frame sides which are retained in the receiving grooves are wider than the depths of their respective receiving grooves. This makes the sides visible to a viewer looking at the screen with a line of vision that is perpendicular to the screen's mesh material surface, thus raising aesthetic issues with the appearance of those sides of the frame.

Some solutions applicable to one or more of these problems may be found in the following U.S. patents: U.S. Pat. No. 246,153 to Koch; U.S. Pat. No. 1,736,688 to Yerby et al.; U.S. Pat. No. 1,756,227 to Torrent; and U.S. Pat. No. 6,484,789 to Ober. However, the present invention provides novel and non-obvious solutions to the deficiencies and drawbacks of the prior art.

SUMMARY OF THE PRESENT INVENTION

The present invention provides an improved groove-attachment screen which solves one or more of the problems described above with regard to conventional groove-attachment screens. In some embodiments, the screens of the present invention may be easily inserted into and removed from the groove into which prior art screens are traditionally inserted. The screens of the present invention include a screen mesh and a screen frame. The screen frame is shaped such that it substantially covers the window or door opening for which it is designed. The screens of the present invention may be shaped as rectangles in commonly used embodiments, though any shape taken by a window or door opening may also be employed within the context of the present invention. The screen frames of the present invention may be formed into the pre-selected shape using multiple side members to define the shape. Alternatively, the screen frame may be formed from a single piece of material.

In some embodiments, the screen mesh is fixedly secured or fused to the screen frame. The screen mesh and screen frame may be fixed together into a single apparatus through various techniques known in the art, such as melting, welding, adhesion, mechanical fastening, or other physical fixation. In some embodiments, the screen mesh and screen frame are both coated in a thermoplastic, such as polyvinyl chloride, nylon, polyethylene, polypropylene, and polystyrene. In those embodiments, the screen mesh and screen frame may be fused together into a single apparatus by melting the thermoplastic coating of each component while they are in contact with one another in a pre-selected shape and allowing the pieces to cool. After cooling, the two components are thus fused together into a single, unitary apparatus.

When assembled, the screens of the present invention adopt a shape that is defined by the door or window opening that the screen is to cover. As used herein, that assembled shape of the screen is referred to as the pre-selected or defined shape. The screen thus defines a perimeter of that opening into which the screen may be placed. The screens of the present invention comprise a screen frame and a screen mesh. When assembled as a complete apparatus, the screen mesh and the screen frame share the preselected shape. Within the context of the present invention, both the screen frame and the screen mesh together define the preselected shape. Standing alone without the screen mesh, the screen frame may adopt a shape that is a relaxed version of the defined shape where the sides of the screen frame bow outward away from the screen center. When screen mesh is secured to the screen frame in the defined shape, the screen mesh acts to cinch the screen frame into the defined shape. As described more fully hereinbelow, the screens of the present invention possess this property through the use of a flexible spring-like material for at least one of the sides of the screen frame. As such, when the screen frame and screen mesh of the present invention adopt the defined shape, both the screen mesh and the screen frame are under tension such that the screen mesh is held substantially taut across the screen frame. This functionality allows the present invention to provide screens that may be easily deformed and removed from the window or door opening in which they are placed without permanently deforming the screen apparatus. Further, by adopting a defined shape, the sides of the screens of the present invention do not force themselves against the window or door frame into which they are inserted. In some embodiments, tabs may be attached to the screen frame to facilitate manipulation of the screen frame during insertion or removal from the door or window opening.

As noted, in some embodiments, at least a portion of the screen frame is fabricated from a material having a spring-like characteristic. As used herein, "spring-like characteristics" means that the material may be substantially deformed or distorted without its shape being permanently altered. As such, the material will return to its originally fabricated shape and dimensions following the deformation. In the context of the present invention, at least a portion of the screen frame may thus be fabricated from a material that allows that portion of the screen frame to be distorted during removal from or placement into any receiving grooves. In certain embodiments, the screen frame may be distorted by an individual applying a force perpendicularly to the screen mesh located towards the middle of the screen, that is, by applying pressure directly into the mesh on the face of the screen. That force applied to the screen mesh results in force being applied to the screen frame, causing the screen frame to bow in towards the center of the screen. When placed in the opening of the door or window, the screens of the present invention typically reside in a receiving groove. During removal of a screen, the individual may press on the mesh perpendicularly to the face of the screen. That applied pressure results in a force being applied to the screen frame, causing substantial distortion of the flexible portion of the screen frame towards the center of the screen, away from the receiving grooves in which the screen is normally placed. The screen frame distorts sufficiently to allow the screen frame to be grabbed manually by the individual, permitting easy removal of the screen from the door or window opening. Following release of the pressure, the screen returns to the defined shape through the spring-like characteristics of the material from which the screen frame is fabricated. The specific structural resilience of the screen frame may be varied widely so that the force required to deform the screen frame or the degree of distortion of the frame may be widely varied. One of skill in the art will recognize circumstances in which greater structural stability of the overall screen may be appropriate.

Through the present innovative design and structure, the screens of the present invention may be placed and retained into a set of parallel receiving grooves of a door or window opening without the need for external springs attached to either the screen frame or the sides of the window or door opening. As noted above, the screens of the present invention need not press against the receiving grooves to secure the screen in place, but instead may reside loosely therein. In some embodiments of the present invention, the width of at least one of the frame side members is less than the depth of its corresponding receiving groove so that the side member is not visible to an observer who is viewing the screen with a line of vision that is perpendicular to the screen. In some embodiments, the screen frame is entirely concealed within the receiving groove. In certain embodiments, at least one portion of the screen frame includes a side member having a transverse cross-section having a width-to-thickness ratio of no greater than about 1.5, and in some embodiments no greater than about 1, where the width is measured in the principal plane of the screen. The width-to-thickness ratio disclosed herein also permits the screen frames of the present invention to easily distort and return to the defined shape.

BRIEF DESCRIPTION OF THE DRAWINGS

The features and merits of the present invention will be better understood by reference to the attached drawings. It is to be understood, however, that the drawings are designed for the purpose of illustration only and not as definitions of the limits of the present invention.

FIG. 3 is an elevational view of another groove-attachment screen according to an embodiment of the present invention in which a pair of parallel receiving grooves of a door or window opening are depicted in phantom.

FIG. 4 is a cross-sectional view of a portion of the screen of FIG. 2 within a receiving groove.

DETAILED DESCRIPTION OF THE INVENTION

It is to be understood that at least some of the figures and descriptions of the invention have been simplified to illustrate elements that are relevant for a clear understanding of the invention, while eliminating, for purposes of clarity, other elements that those of ordinary skill in the art will appreciate may also comprise a portion of the invention. However, because such elements are well known in the art, and because they do not facilitate a better understanding of the invention, a description of such elements is not provided herein.

Whenever the term "about" is used herein or in the appended claims to modify a feature of an embodiment of the present invention, it is to be construed as referring to the ordinary tolerances related to making and/or measuring the relevant feature. Whenever a range is used herein or in the appended claims to describe a feature of an embodiment of the present invention, the range is to be construed as including the stated or implied end points of the range and every point therebetween.

The present invention provides an improved groove-attachment screen that may be easily inserted into and removed from the groove into which prior art screens are traditionally inserted. The screens of the present invention include a screen mesh and a screen frame. The screen frame is shaped such that it substantially covers the window or door opening for which it is designed. The screens of the present invention possess a novel structure that allows them to be easily inserted into and removed from those door or window openings. This novel functionality is achieved by a novel screen frame and screen mesh combination. At least one side of the screen frame is fabricated from a material having spring-like characteristics that allows the screen frame to be distorted and to return to its original shape. The degree of the distortion is such that it allows an individual inserting or removing the screen to easily grip and manipulate the frame, as described more fully hereinbelow.

Figure 1:
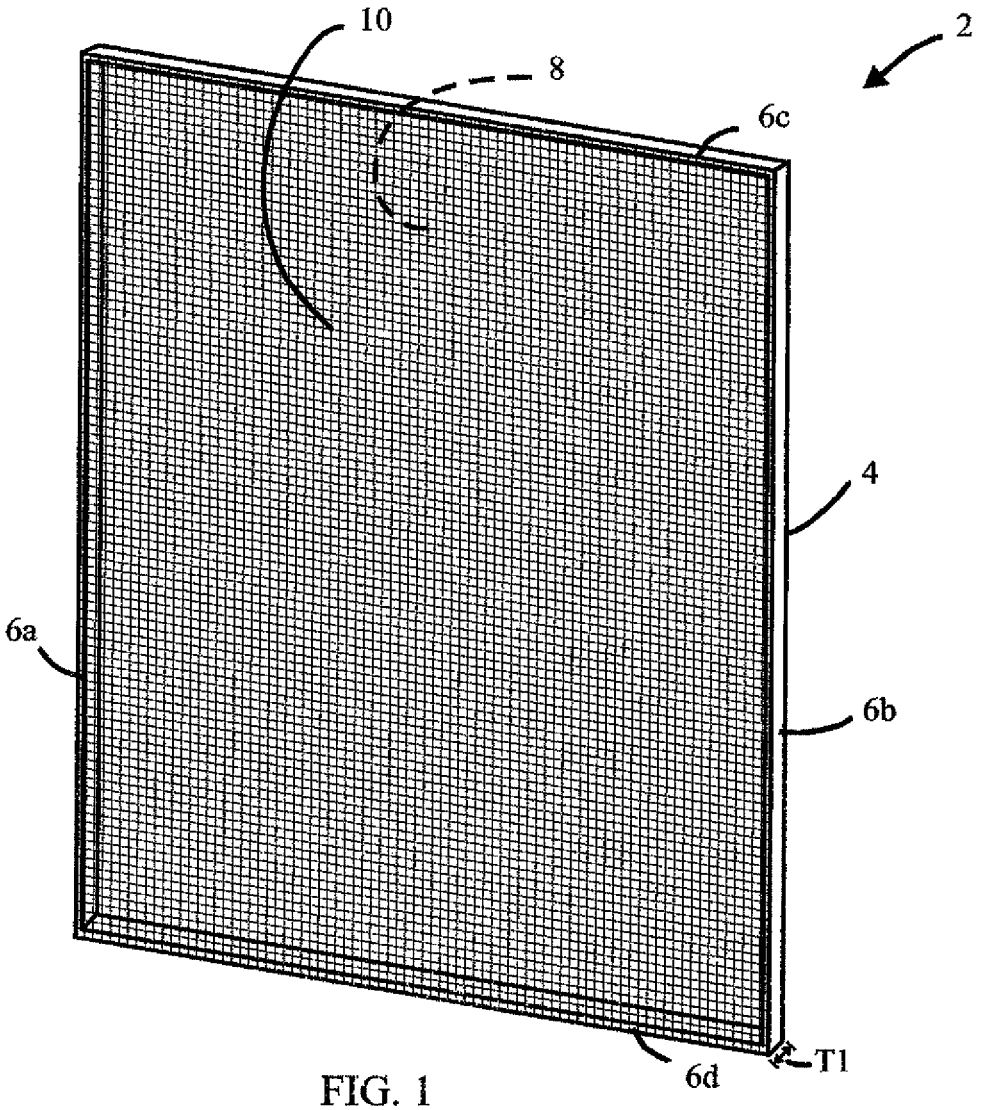
FIG. 1 is a perspective view of a groove-attachment screen according to an embodiment of the present invention.

Referring to FIG. 1, there is shown a perspective view of a groove-attachment screen 2 according to an embodiment of the present invention. The screen 2 has a screen frame 4 having four side members 6*a*-6*d* which form an aperture 8 therebetween. As noted above, the screen frame may also be fabricated from a single piece of material, as appropriate for the specific implementation at hand. The screen 2 also includes a screen mesh 10 that is fixedly attached to the frame 4 so as to cover aperture 8. The screen 2 has an overall thickness T1, which includes the thickness of the relevant side members 6*a*-6*d* and the screen mesh 10.

Figure 2:
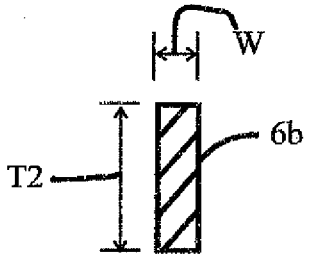
FIG. 2 is a transverse cross-sectional view of a side member of the screen of FIG. 1.

A transverse cross-sectional view of side member 6*b* of the screen frame is shown in FIG. 2. The side member 6*b* has a width W and a thickness T2. It is to be understood that the thickness of the side members, e.g. thickness T2, is measured perpendicular to the plane defined by the screen mesh 10 and the width of the side members, e.g., width W, is measured parallel to the plane defined by the screen mesh 10.

Referring now to FIG. 3, there is shown an elevational view of a screen 12 which is similar to screen 2 except that screen 12 has an optional tab 14 attached to the screen frame 16. In the embodiment shown in FIG. 3, the screen frame 16 includes the four side members 18*a*-18*d*. The screen 12 also comprises a screen mesh 20 which is fixedly attached to the frame 16. Superimposed upon screen 12 are pair of dashed lines which represent the outer lips of two parallel receiving grooves 22*a*, 22*b* of a door or window opening by which screen 12 is retained in the opening. Although the dashed lines show the receiving grooves 22*a*, 22*b* as being vertically disposed, they may take on any physical orientation that is sufficient to hold the screen in place.

Referring to FIG. 4, there is shown a cross-sectional view of a portion of the screen 12 referred to in FIG. 3, seated within receiving groove 22*b*. The receiving groove 22*b* is a full groove that includes first and second retaining walls 24*a*, 24*b* and a bottom or seating surface 26. The depth D of the receiving groove 22*b* is the distance between the lip 28 of the first retaining wall 24*a* and the bottom 26. Here, the side member 18*b* is seated against both the second side wall 24*b* and the bottom 26 and the screen mesh 20 is seated against first retaining wall 24*a*. Note that the width of side member 18*b* is substantially less than the depth D of receiving groove 22 in this embodiment. As such, the screen frame 16 does not obscure the line of sight through the door or window opening in this embodiment.

Figure 5:
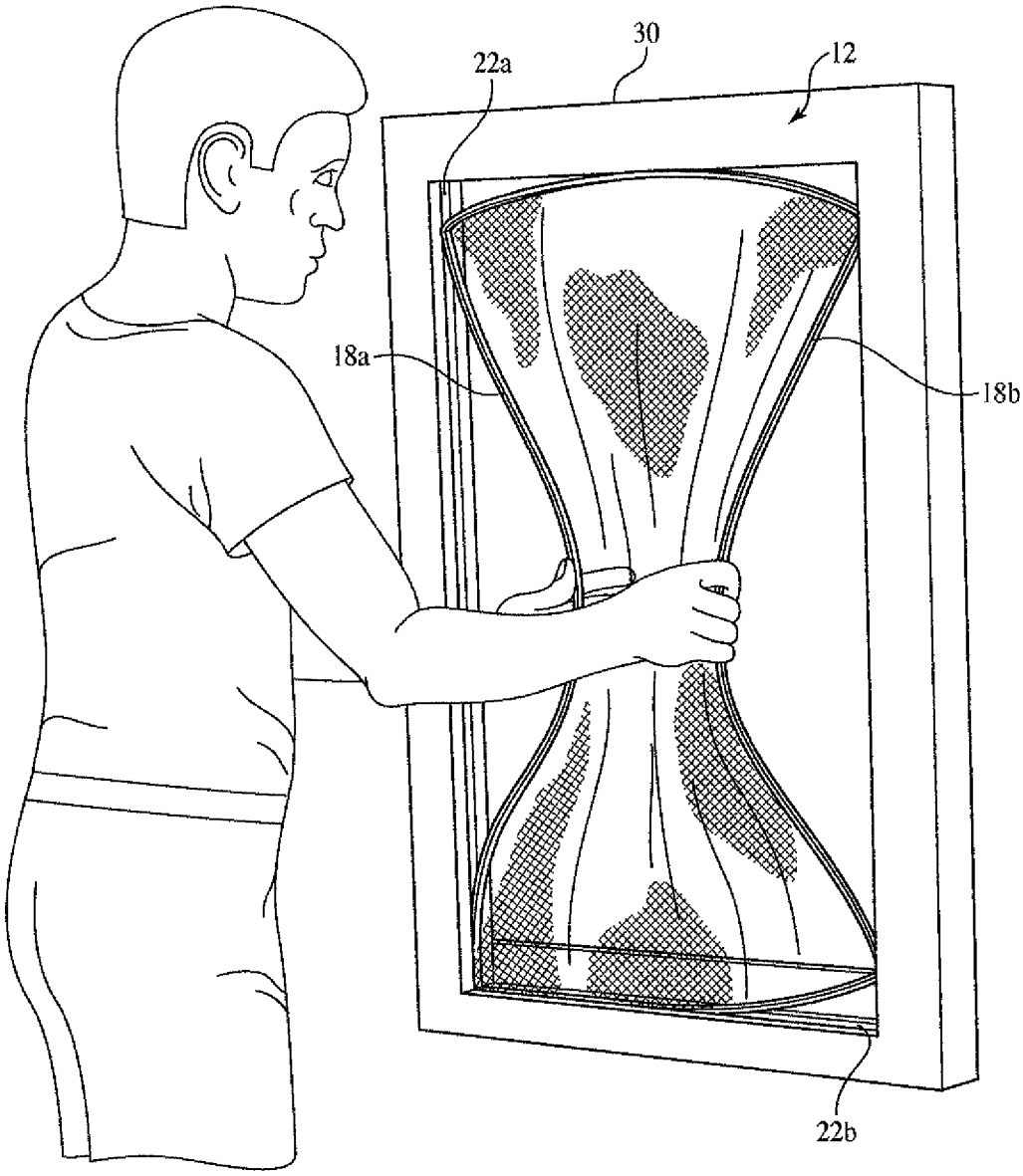
FIG. 5 is a perspective view of a groove-attachment screen according to an embodiment of the present invention in a collapsed position during the process of being removed from a window frame.

Referring to FIG. 5, there is shown a perspective view of one embodiment of a screen 12, constructed in accordance with the present invention, wherein side members 18*a* and 18*b* have been pushed substantially toward each other by a user in order to either remove the screen 12 from a window frame 30 or insert the screen 12 into the frame 30. In the collapsed position illustrated in FIG. 5, the screen 12 is very easy to install or remove from receiving grooves 22*a* and 22*d*. The other two receiving grooves are not visible due to the perspective nature of the view.

In the screens of the present invention, at least one side member of the screen frame are made of a material having spring-like characteristics. As used herein, "spring-like characteristics" means that the material may be substantially deformed or distorted without its shape being permanently altered. As such, the material will return to its originally fabricated shape and dimensions following the deformation. Stated differently, the material from which the screens of the present invention are fabricated is stiff enough to provide the screen with sufficient rigidity to retain the screen in the window or door opening under normal environmental conditions, while at the same time be able to be distorted such that the frame is easily removed from that opening. Suitable materials include, without limitation, metals (e.g., steel, stainless steel, aluminum, bronze, copper, brass), polymers, composites, fiberglass, and wood.

In one embodiment, the screen frame is constructed of oil tempered flat wire, such as C1065 high carbon spring steel, having a width of about 0.09 inches and a thickness of about 0.225 inches. In another embodiment, the dimensions are different and the flat wire has a width of about 0.156 inches and a thickness of about 0.225 inches. In both examples, the wire has a natural round edge and a smooth clean finish and a tensile strength of 150/220 ksi. Further, the width dimensions are provided plus or minus about 0.002 inches and the thickness dimensions are provided plus or minus about 0.005 inches. Of course, those of skill in the art will recognize that other cross-sectional shapes of wire, as well as other materials besides steel, can be used without departing from the scope of the invention.

The overall frame is sized to fit the opening in which the screen is intended to be used. The screens of the present invention are depicted herein as having a rectangular shape, though that is not limiting. The screens of the present invention may be in any shape including, but not limited to, rectangular, circular, triangular, or other polygon-based shapes such as stars, diamonds, or the like. The screens of the present invention may also be combinations of those shapes, for example with one end of the screen being formed as a semicircle while the opposite end of the screen being a rectangle. One of skill in the art will recognize that the screens of the present invention may be fabricated in any shape as dictated by the specific implementation at hand.

In some embodiments, the frame may be sized so that when the screen is placed in the door or window opening, the screen frame will seat into the door or window opening with some amount of elastic force being provided by the frame against the sides of the opening. However, looser fits of the screen within the intended opening are also within the scope of the present invention and may be employed when the specific circumstances of the application render such a fit to be appropriate.

The screen mesh in the screens of the present invention may be fabricated from any mesh material that is compatible with the environment in which the screen is to be used and with the screen frame materials. In some embodiments, the mesh material is a light-weight material and/or one that provides easy passage of air and light without being distracting to a person who is attempting to look through the screen. In other embodiments, any mesh materials meeting the above-stated compatibility criteria are within the scope of the present invention. Suitable mesh materials include, without limitation, those made from fiberglass, polymers, and metals (e.g., aluminum, steel, stainless steel, brass, bronze, and copper). The size of the mesh may be selected based upon the amount of airflow and the size of the insects, debris, etc., that the screen is intended to exclude. In an embodiment, the screen mesh is constructed of a woven vinyl-coated fiberglass fabric.

In the present invention, the screen mesh is fixedly attached to the screen frame. This means that, once attached to each other, the relative positions of the screen mesh and the screen frame do not change at their attachment points or areas. The mechanism of attachment is selected so that it is compatible with the mesh material and the frame material taking into consideration the environment in which the screen is to be used. Suitable means of attachment include, without limitation, melting, welding, adhesion, mechanical fastening, or other physical fixation. Welding techniques useful within the context of the present invention include thermal, chemical, radio frequency, electronic, frictional, and injection techniques. Examples of mechanical or physical fixation include adhesives (where the screen mesh is glued to the screen frame), tapes (where the screen mesh is secured to the screen frame using double-sided tape), mechanical fasteners (e.g., rivets, nails), or Velcro (with the male Velcro on the screen mesh and the female Velcro on the screen frame, or the converse) to bond the screen mesh to the frame. In certain embodiments, the screen mesh may be folded over onto itself to form a loop. That loop may be sewed in place to form a pocket into which the screen frame may be placed.

In some embodiments, the screen mesh and screen frame are both coated in a thermoplastic, such as polyvinyl chloride (PVC), nylon, polyethylene, polypropylene, and polystyrene. In those embodiments, the screen mesh and screen frame may be fused together into a single apparatus by melting the thermoplastic coating of each component while they are in contact with one another in a pre-selected shape and allowing the pieces to cool. After cooling, the two components are thus fused together into a single, unitary apparatus. The screen mesh may be sized to fit against a face of the screen frame or it may be sized to wrap partially or completely around one or more side of the screen frame. The screen mesh may also be sized so as to cover both sides of the screen frame.

In embodiments where the screen is in a rectangular shape, two parallel sides of the screen frame of the present invention may be adapted to fit within respective parallel full or partial receiving grooves of the door or window opening. In some embodiments, the screen frame has a width that is less than or equal to the depths of the receiving grooves into which it is received. This condition renders the screen frame invisible to an observer who is viewing the screen with a line of vision that is perpendicular to the screen's mesh surface. However, the present invention also includes embodiments having one or more side members that are wider than the depth of the relevant receiving grooves. In some embodiments, the screen mesh wraps around one or more sides of the screen frame. In such embodiments, the amount of space that will be taken up by the mesh material also may be taken into account in adapting a side member to fit within a receiving groove. In some embodiments, the screen frame and mesh fit snugly in the relevant receiving groove to prevent the screen from rattling. However, looser fits are also within the scope of the present invention as dictated by the implementation at hand. In some embodiments of the present invention, one or both of the sides of the screen frame placed into the receiving grooves have widths that are no more than about 0.75 inches.

When assembled, the screens of the present invention adopt a shape that is defined by the door or window opening that the screen is to cover. As used herein, that assembled shape of the screen is referred to as the pre-selected or defined shape. The screen thus defines a perimeter of that opening into which the screen may be placed. The screens of the present invention comprise a screen frame and a screen mesh. When assembled as a complete apparatus, the screen mesh and the screen frame share the preselected shape. Within the context of the present invention, both the screen frame and the screen mesh together define the preselected shape. Standing alone without the screen mesh, the screen frame may adopt a shape that is a relaxed version of the defined shape where the sides of the screen frame bow outward away from the screen center. When screen mesh is secured to the screen frame in the defined shape, the screen mesh acts to cinch the screen frame into the defined shape. As described more fully, the screens of the present invention possess this property through the use of a flexible spring-like material for at least one of the sides of the screen frame. As such, when the screen frame and screen mesh of the present invention adopt the defined shape, both the screen mesh and the screen frame are under tension such that the screen mesh is held substantially taut across the screen frame. This functionality allows the present invention to provide screens that may be easily deformed and removed from the window or door opening in which they are placed without permanently deforming the screen apparatus. Further, by adopting a defined shape, the sides of the screens of the present invention need not force themselves against the window or door frame into which they are inserted.

As noted, the screen frame is fabricated from a material having a spring-like characteristic. As used herein, "spring-like characteristics" means that the material may be substantially deformed or distorted without its shape being permanently altered. As such, the material will return to an original shape and dimensions following the deformation. In the context of the present invention, the screen frame may thus be fabricated from a material that allows the screen frame to be distorted during removal from or placement into any receiving grooves. In some embodiments, at least one side of the screen frame is made of an elastic material with spring-like characteristics and dimensioned so as to have a transverse width-to-thickness ratio of no more than about 1.5, and in some embodiments no more than about 1. The material used in the examples discussed in this application, for example, have a transverse width-to-thickness ratio of less than 1. This combination of features permits the side member to be urged inward toward the screen frame's center and facilitates the installation and removal of the screen from the door or window opening. In certain embodiments, two, three, or all of the sides of the screen frame have such features so as to further facilitate such installation and removal.

In certain embodiments, the screen frame may be distorted by an individual applying pressure perpendicularly to screen mesh located towards the middle of the screen, that is, by apply pressure directly into the mesh on the face of the screen. That application of force results in a force being transferred to the screen frame, resulting in distortion of the screen frame towards the center of the screen. During removal of a screen of the present invention that is placed in receiving grooves in a door or window opening, for example, the individual may press on the mesh towards the center of the screen. That applied pressure results in a distortion of the screen frame towards the center of the screen, away from the receiving grooves in which the screen is normally held during use. The screen frame may then be grabbed manually by the individual, allowing for easy removal of the screen from the door or window opening. Following release of the pressure, the screen returns to the defined shape through the spring-like characteristics of the material from which the screen frame is fabricated. The specific structural resilience of the screen frame may be varied widely so that greater or lesser force may be required to deform the screen frame. One of skill in the art will recognize circumstances in which greater structural stability of the overall screen may be appropriate.

Those portions of the screen frame that are not placed into the receiving grooves of the door or window openings may also be fabricated from the same or a similar material having spring-like characteristics. In some embodiments, different portions of the screen frame may possess distinct physical characteristics (e.g., elasticity, rigidity, and thickness), depending on the desired properties of the screen. In some embodiments, the portions of the screen frame not placed into receiving grooves may also have a transverse width-to-thickness ratio of no more than about 1.5, and in some embodiments no more than about 1. In certain embodiments, those portions of the screen frame have widths that are no more than about 0.75 inches. However, it is to be understood that portions of the screen frame that are not elastic and/or have width-to-thickness ratios greater than about 1.5 and/or have widths of greater than about 0.75 inches are within the scope of the present invention.

In some embodiments of the present invention, the screen frame is fabricated from a single piece of material. In those embodiments, the entire screen frame will be fabricated from a material having spring-like characteristics and will be welded or otherwise connected in only a single spot, which may be at a corner or at some point along a side. In this embodiment, wire coil is used to form the screen frame by means of manual or automatic machine wire forming and is welded in either the same or a secondary operation. After forming the frame, it is passed through a cleaning, sealing and rinse process and is then dried in an oven, which prepares it for powder coating. The frame is then run through a PVC powder coating process and is then cured in another oven. The coated frame then has screen mesh applied by means of manual or automatic welding either via an overlap weld, hem weld or butt weld with a hot air hot wedge or impulse welding process.

In other embodiments, the screen frame may have only one side that is fabricated from a material having spring-like characteristics, while the remaining sides are fabricated from a rigid material. In still other embodiments, a rectangular screen frame may have two opposite or adjacent sides fabricated from a material having spring-like characteristics, while the other sides are fabricated from a rigid material. In each of those embodiments, the screen may be removed in the same manner as described above (i.e., by applying force perpendicularly to the face of the screen), resulting in the distortion of those portions of the frame that are fabricated from the spring-like material. In still other embodiments, the screen frame may be formed from individual pieces that define each side of the frame. The pieces may be joined at junctions or corners by corner pieces. Each of the side pieces and each corner piece may be fabricated from either rigid or spring-like material, as dictated by the demands of the specific implementation at hand.

It is to be understood that although the side portions of the screen frame are depicted in the drawing as having rectangular transverse cross-sectional shapes, the cross-sectional shape of the screen frame may take on any configuration and may even change from shape to shape along the length of the screen frame. When non-rectangular cross-sectional shapes are used, the width of the cross-section is to be defined as the dimension that is parallel to the plane of the screen mesh and the thickness as the dimension that is perpendicular to the plane of the screen mesh.

It is also to be understood that although the side portions of the screen frame are depicted in the drawings to be continuous from end to end, a side portion of the screen frame may be made of component pieces and the components pieces may be made of the same or different materials from one another. Also, it is to be understood that the individual side members of the screen frame may be interconnected discrete pieces or they may be combined so that one piece constitutes more than one side member or even the entire screen frame. Connections, whether they are between component parts of an individual side member or between any other components of the screen frame, may be made by any known means, including without limitation, welds, adhesives, and mechanical fasteners or any combination thereof.

Methods of installing the groove-attachment screens of the present invention vary depending upon how many of the side portions of the screen frame have the features of being made of a material having spring-like characteristics. For an embodiment having just one such side member (the "featured side member"), one method of installation is as follows. First, the screen is angled so as to seat the side member of the screen frame that is parallel to the featured side member into its respective receiving groove. Then, as the screen is rotated into the plane defined by the parallel receiving grooves of the door or window opening, a lateral force is applied to the featured side causing it to bow into the frame aperture so that the featured side is able to slip by the lip of its receiving groove. The force is then relieved allowing the featured side to move into its receiving groove. Removal of the screen may be accomplished by applying an outwardly directed force against the screen mesh so as to cause the featured side to bow into the frame aperture. The featured side is then grasped and a lateral force is applied to it so as to bow it out of its receiving groove. The screen is then rotated and the side member that is parallel to the featured side member is then pulled out of its receiving groove.

In embodiments of the present invention having two parallel portions of the screen frame fabricated from a spring-like material, one method of screen installation is to apply lateral forces to bow both of the side members towards the center of the screen, position the screen against the door or window opening, and then to release the featured sides so that they enter into their respective receiving grooves. A method of removal is the same as described above for the embodiments having only a single featured side member.

In embodiments of the present invention having one or more optional tabs attached to the screen frame, the tab or tabs may be used to grasp the side members in the installation and removal of the screens. The tabs may be attached to a portion of the screen frame fabricated from a spring-like material and can be used to grasp the featured side during a bowing step. The tabs may be dimensioned and structured to allow simple grasping of the tab. The tabs may be constructed of materials that provide sufficient strength to allow bowing of the screen frame. The shape, size, and construction of a tab may be varied widely and are limited only by their ability to be useful in allowing an individual to effect bowing of the screen frame.

In the embodiments of the present invention shown in the drawings, the groove-attachment screens have two sets of parallel sides. It is to be understood, however, that the present invention also includes embodiments in which one or two of the sides members are arched. Also, in the embodiments of the present invention shown in the drawings, the corners of the screen frame are square. However, it is to be understood that the present invention includes within its scope embodiments in which one or more of the junctions of the side members are at angles other than right angles and/or are rounded.

While only a few embodiments of the present invention have been shown and described, it will be apparent to those skilled in the art that many changes and modifications may be made to the disclosed apparatuses and methods without departing from the spirit and scope of the present invention. All patent applications, patents, and all other publications referenced herein are incorporated herein in their entireties to the full extent permitted by law.

What is claimed is:

1. A screen adapted to be removably captured within receiving grooves that run along a perimeter of a door frame opening or window frame opening, the screen comprising:

a resilient screen frame having a flexible spring-like characteristic, wherein the screen frame forms a plane, wherein the screen frame is capable of being distorted in a direction parallel to the plane of the screen frame, wherein the screen frame is capable of assuming a defined shape, substantially similar to a window or door frame opening and the screen frame is adapted to be at least partially concealed within receiving grooves of a door frame or window frame;

a defined shape sized screen mesh secured to the screen frame, wherein the screen mesh keeps the screen frame in the defined shape under tension provided by the spring-like characteristic of the screen frame;

where the screen frame is distorted from the defined shape when a force is applied against the screen frame, and where the screen frame and screen mesh retain the defined shape when the force is removed; and a door or window frame having receiving grooves located on the door or window frame such that the door or window may be in a closed position simultaneously with the screen being contained within the receiving grooves, wherein the receiving grooves are of a depth D such that the width W of the side members of the screen frame are substantially less than the depth D so that the screen frame does not obscure the line of sight through the door or window opening.

2. The screen of claim 1, wherein the screen frame may be distorted sufficiently to allow the screen to be inserted into and removed from the receiving grooves.

3. The screen of claim 1, wherein said screen frame is distorted by the force sufficiently to permit the screen frame to bow away enough from a groove so as to be grasped by a person's hand and then to bow sufficiently upon application of a lateral force to the screen frame to cause a portion of the screen frame to withdraw from its respective groove.

4. The screen of claim 1, wherein the screen mesh is secured to the screen frame by melting, welding, adhesion, or mechanical fastening.

5. The screen of claim 4, wherein the screen frame and the screen mesh each include a thermoplastic coating.

6. The screen of claim 5, wherein the screen frame and screen mesh are melted together by melting the thermoplastic coating of the screen mesh and the thermoplastic coating of the screen frame together.

7. The screen of claim 5, wherein said thermoplastic is selected from the group consisting of polyvinyl chloride, nylon, polyethylene, polypropylene, and polystyrene.

8. The screen of claim 5, wherein the screen frame is spring steel and wherein the screen frame and screen mesh form a unitary apparatus.

9. The screen of claim 1, wherein the screen frame includes a plurality of tabs attached to the screen frame where the tabs may be used to apply the force against the screen frame.

10. The screen of claim 1 wherein the force is applied to said frame by applying a force perpendicularly to the screen mesh.

11. The screen of claim 1, wherein said defined shape is a rectangle, circle triangle, or polygon.

12. The screen of claim 1, wherein said screen frame is wholly concealed within the receiving grooves.

13. The screen of claim 1, wherein said screen frame comprises a single piece of material fabricated from a material having a flexible spring-like characteristic.

14. The screen of claim 1, wherein the screen frame comprises a plurality of side members that establish the defined shape.

15. The screen of claim 14, wherein at least one of said side members possesses the spring-like characteristic.

16. The screen of claim 14, wherein each side member is comprised of a separate piece of material.

17. The screen of claim 14, wherein said side members are joined together by corner pieces to form said defined shape.

18. The screen of claim 14, wherein said side members have a transverse width-to-thickness ratio of no more than 1.5.

19. The screen of claim 14, wherein said side members have a transverse width-to-thickness ratio of no more than about 1.

20. The screen of claim 1, wherein the screen is smaller than the defined shape yet still spans the entire frame opening.

21. The screen of claim 14, wherein at least one side member is capable of being independently distorted, while other side members remain essentially in the defined shape.

22. The screen of claim 14, wherein each side member is capable of being independently distorted, while other side members remain essentially in the defined shape.

23. The screen of claim 14, wherein at least one side member is capable of bowing sufficiently into the frame opening when the force is applied perpendicularly against the screen mesh adjacent to that side member to permit that side member to be grasped by a person's hand and to bow sufficiently further in the frame opening upon the application of a lateral force to that side member to cause that side member to withdraw from its respective groove.

24. The screen of claim 14, wherein each side member is capable of bowing sufficiently into the frame opening when the force is applied perpendicularly against the screen mesh adjacent to itself to permit each side member to be grasped by a person's hand and to bow sufficiently further in the frame opening upon the application of a lateral force to itself to cause each side member to withdraw from its receptive groove.

25. The screen of claim 1, wherein the screen mesh is comprised of a thermoplastic coated fabric.

26. A screen adapted to be removably inserted into a frame opening having a defined shape, the screen having a first fully expanded configuration and a second collapsed configuration different that the first fully expanded configuration, the screen further comprising a flexible wire frame with three or more sides having an outwardly biased bow, wherein at least three of the sides of the frame are flexible, and a screen mesh, sized to match the defined shape, fixably disposed on the wire frame whereby the outwardly biased sides keep the screen mesh taut and the screen frame is adapted to be at least partially concealed within the receiving grooves of a door frame or window frame; and a door or window frame having receiving grooves of a depth D such that the width W of the side members of the screen frame are substantially less than the depth D so that the screen frame does not obscure the line of sight through the door or window opening wherein the door or window frame contains a door or window capable of being in a closed position simultaneously with the screen frame being contained with receiving grooves.

27. The screen of claim 1 wherein the defined shape of the screen frame is adapted such that the screen frame does not force itself against the receiving grooves of a door frame or window frame.

* * * * *